US012449137B2

(12) United States Patent
Miranda et al.

(10) Patent No.: US 12,449,137 B2
(45) Date of Patent: Oct. 21, 2025

(54) COOKTOP OVEN GASKET LOCATION AND FASTENERS

(71) Applicant: Haier US Appliance Solutions, Inc., Wilmington, DE (US)

(72) Inventors: Mariana Miranda, Louisville, KY (US); Daniel Ian Moore, Louisville, KY (US); Lydia Stempky, Louisville, KY (US); Monica Martinez Mendez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 733 days.

(21) Appl. No.: 17/692,596

(22) Filed: Mar. 11, 2022

(65) Prior Publication Data

US 2023/0288074 A1 Sep. 14, 2023

(51) Int. Cl.
*F24C 15/08* (2006.01)

(52) U.S. Cl.
CPC ..... *F24C 15/08* (2013.01)

(58) Field of Classification Search
CPC ..... F24C 15/08; F24C 7/082
USPC ..... 126/19 R
See application file for complete search history.

(56) References Cited

U.S. PATENT DOCUMENTS 4,250,865 A * 2/1981 Scherer ..... F24C 7/082 126/41 D
4,305,230 A * 12/1981 Gerritsen ..... F25D 23/087 49/492.1
4,784,741 A 11/1988 Boulton et al.
5,341,601 A 8/1994 Moyer
5,453,586 A 9/1995 Stottmann
5,816,080 A * 10/1998 Jeziorowski ..... F25D 23/087 49/478.1
7,093,838 B2 8/2006 Hight et al.
9,447,628 B2 9/2016 Qiang et al.
10,376,098 B2 * 8/2019 Chun ..... F28F 9/0226
2005/0194004 A1 * 9/2005 Boswell ..... F24C 15/102 126/211
2006/0150565 A1 * 7/2006 Schacht ..... E04F 19/062 52/716.1

(Continued)

FOREIGN PATENT DOCUMENTS

CN 205316432 U * 6/2016 ..... F24C 15/20
DE 20103048 U1 * 6/2001 ..... A47L 23/24
JP S61141617 U * 9/1986

OTHER PUBLICATIONS

Chinese to English machine translation for (Year: 2016).*
German to English machine translation for (Year: 2001).*
Japanese to English translation of JPS61141617U.*

*Primary Examiner* — Michael G Hoang
*Assistant Examiner* — Elizabeth Ann Laughlin
(74) *Attorney, Agent, or Firm* — Dority & Manning, P.A.

(57) ABSTRACT

An oven appliance includes a cabinet defining a cooking chamber to receive items to be cooked, a cooktop situated above the cooking chamber, and a door. A user interface panel is situated above the door and in front of the cooktop. A gasket occupies the space between the user interface panel and the cooktop, wherein the gasket includes several protrusions on its ends and central body that serve as both locators for consistently orienting the gasket with respect to the user interface panel during assembly and connectors for securing the gasket to the user interface panel.

14 Claims, 8 Drawing Sheets

(56) References Cited

U.S. PATENT DOCUMENTS

| | | | | |
|---|---|---|---|---|
| 2016/0334113 | A1* | 11/2016 | Lee | F24C 15/08 |
| 2020/0271326 | A1* | 8/2020 | Kozinski | F24C 3/124 |

* cited by examiner

COOKTOP OVEN GASKET LOCATION AND FASTENERS

FIELD OF THE INVENTION

The present subject matter relates generally to oven appliances, and more particularly to oven gasket location and security.

BACKGROUND OF THE INVENTION

Conventional residential and commercial oven appliances generally include a cabinet that defines a cooking chamber for receipt of food items for cooking. A door is attached to the cabinet, rotating between an open and closed position. A control panel is often situated above the door, the top of the control panel being substantially flush with the oven cooktop. The gap formed between the cooktop and the control panel is filled with a gasket. The gasket is typically attached to the cabinet using gasket clips.

Such gasket clips are effective at securing the gasket in place during assembly, prior to attachment of the control panel to the cooktop. However, the corresponding point of attachment for these gasket clips is typically a hole in the cabinet or control panel that is not specifically designed to accommodate the particular shape and stiffness of the gasket clips. As a result, attachment of the gasket clip fails to provide sufficient tension to the gasket, thus allowing the gasket to lift over time. This lifting allows debris into the space between the control panel and the cooktop. Further, lifting interferes with the aesthetics of the gasket, interrupting the flush appearance of the oven's most visible surface.

Additionally, use of gasket clips may be problematic in assembly. Gasket clips are typically inserted by aligning the gasket clip with an opening and using the thumb to exert sufficient force to overcome the stiffness of the gasket clip, allowing the gasket clip to collapse and slide through the hole. However, the gasket clips may have sharp ends that make pushing of the gasket difficult or uncomfortable for the assembler. Moreover, the sharp ends of the gasket clips risk tearing portions of the gasket, which may further reduce the tension that the gasket clips exert on the gasket, exacerbating the gasket lifting problems identified previously.

Accordingly, oven appliances having improved manner of attaching and securing a gasket would be desirable. Specifically, oven appliances using a gasket having a simplified, ergonomic manner of attachment would be desirable. Further, a gasket attachment mechanism that provides increased and consistent tension, reducing lifting of the gasket, would also be desirable.

BRIEF DESCRIPTION OF THE INVENTION

Aspects and advantages of the invention will be set forth in part in the following description, or may be obvious from the description, or may be learned through practice of the invention.

In one aspect of the present disclosure, an oven appliance is provided. The oven appliance includes a cabinet to receive items to be cooked, a door pivotably attached to the cabinet, a user interface panel, and a gasket. The cabinet includes a cooktop situated above the cooking chamber. The door pivots between an open position and a closed position and covers the front opening of the cooking chamber when in the closed position. The user interface panel is situated above the door and vertically aligned with an in front of the cooktop. The gasket occupies the space between the user interface panel and the cooktop. The gasket further includes a first end, a second end, and a central body. A first protrusion extends from the first end, a second protrusion extends from the second end, and a third protrusion extends from the central body.

In another aspect of the present disclosure, an oven appliance is provided. The oven appliance includes a cabinet to receive items to be cooked, a door pivotably attached to the cabinet, a user interface panel, and a gasket. The cabinet includes a cooktop situated above the cooking chamber. The door pivots between an open position and a closed position and covers the front opening of the cooking chamber when in the closed position. The user interface panel is situated above the door and vertically aligned with an in front of the cooktop and includes a rear surface and is attached to the rear surface of the user interface panel. The gasket occupies the space between the user interface panel and the cooktop. The gasket further includes a first end, a second end, and a central body. A first protrusion extends from the first end, a second protrusion extends from the second end, and a third protrusion extends from the central body.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
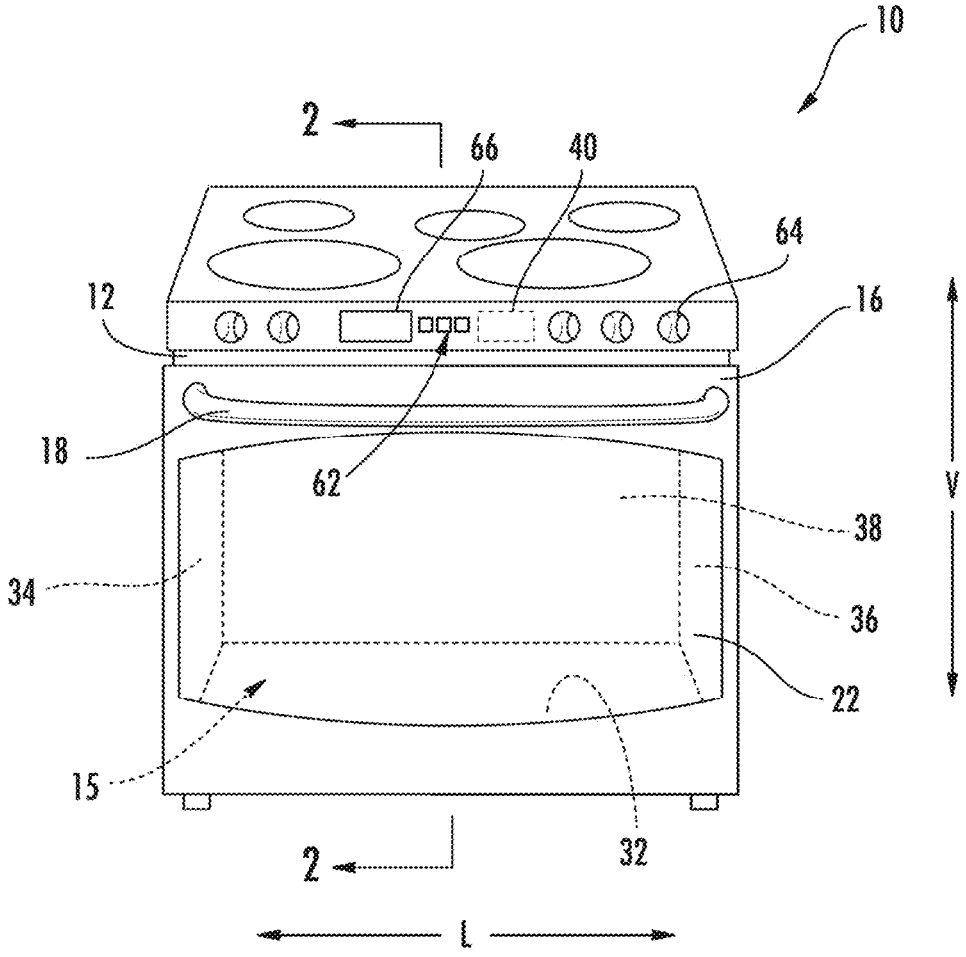
FIG. 1 provides a front perspective view of an oven appliance according to one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," "substantially," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. As also used here, terms such as "front" or "back" are to be understood from the perspective of a user of the oven appliance, i.e., a person facing the side of the oven appliance including the door and control panel.

Figure 2:
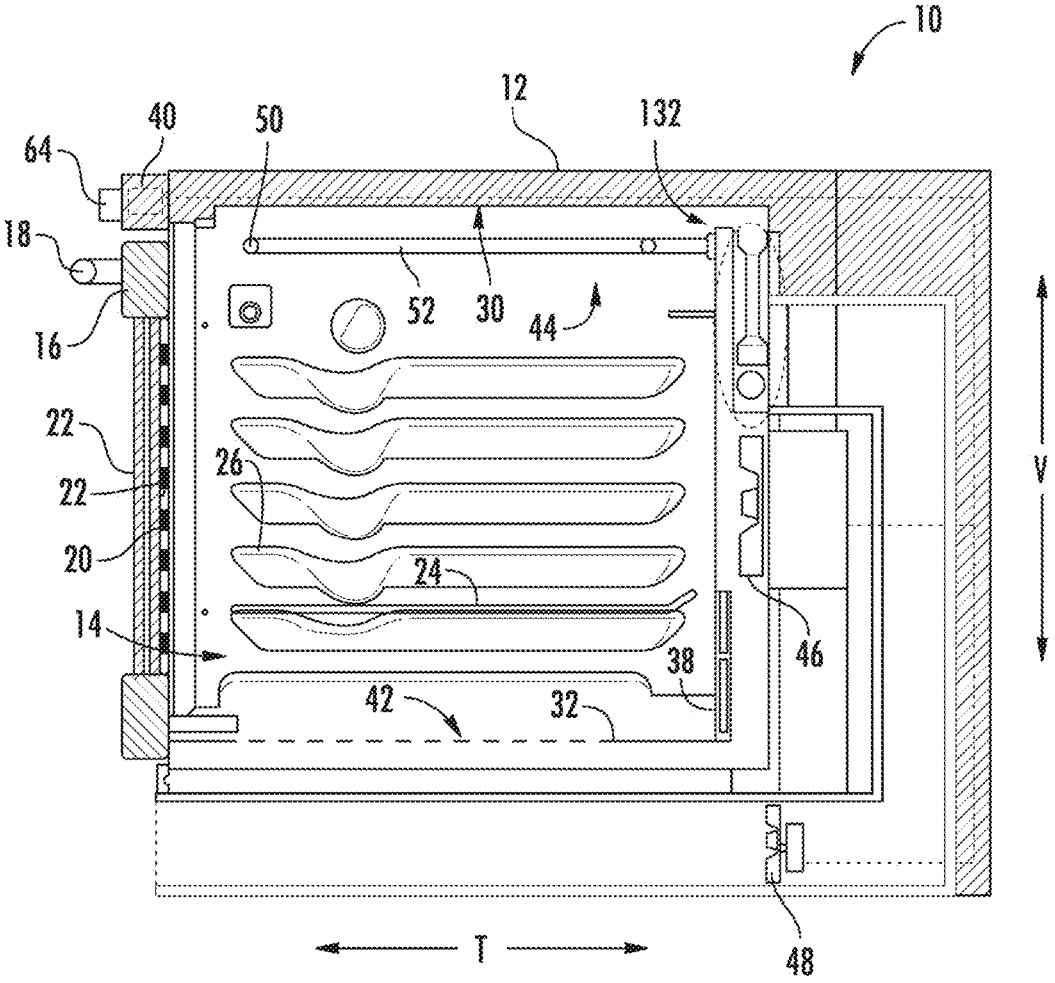
FIG. 2 provides a sectional view of the exemplary oven appliance of FIG. 1 taken along the line 2-2 of FIG. 1.

Turning now to the figures, FIGS. 1 through 2 provide views of an example oven appliance which may incorporate embodiments of the present subject matter. For instance, FIG. 1 provides a perspective view of an oven appliance 10 according to example embodiments of the present subject matter. FIG. 2 provides a section view of oven appliance 10 taken along the 2-2 line of FIG. 1. Oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable oven appliance. For example, the oven appliance may include multiple interior cavities that define multiple heating chambers in the oven appliance. Thus, the present subject matter may be used with other oven or range appliance configurations, e.g., that define multiple interior cavities for the receipt of food and/or having different configuration than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access opening 20 to cooking chamber 14. For example, a user can pull on handle 18 to open or close door 16 and access cooking chamber 14 through front opening 20.

Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various walls define the cooking chamber 14. For example, cooking chamber 14 includes a top wall 30 and a bottom wall 32 which are spaced apart along the vertical direction V. Left sidewall 34 and right sidewall 36 (as defined according to a perspective front view as shown in FIG. 1, e.g., from the perspective of a user facing the oven appliance 10 to access/use the oven appliance 10 and/or cooking chamber 14) extend between the top wall 30 and bottom wall 32, and are spaced apart along the lateral direction L. A rear wall 38 additionally extends between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

Optionally, a lower heating assembly 42 may be included in oven appliance 10, e.g., for baking operations within cooking chamber 14. Lower heating assembly 42 may include a discrete heating element (not pictured) which is disposed within the cooking chamber 14, such as adjacent to the bottom wall 32. In some embodiments, the lower heating assembly 42 includes a gas burner. Additional components, such as an igniter and a fuel line may be provided in some such embodiments. Alternatively, the lower heating assembly 42 may include an electric heating element or may be any other suitable bake assembly having any other suitable heating element.

An upper heating assembly, such as a broiler assembly 44, may be included in oven appliance 10. Broiler assembly 44 includes a convection heating element 50 and a radiant heating element 52. The radiant heating element 52 may be an electric heating element, such as a resistive heating rod as illustrated in FIG. 2. The convection components of broiler assembly 44 include one or more air handlers 46, 48, e.g., fans or blowers, and a convection heating element 50. As illustrated, convection heating element 50 is generally positioned away from cooking chamber 14 such that convection heat (and not radiation heat) is received in cooking chamber 14 from convection heating element 50. Convection heating element 50 may be an electric heating element, such as a resistive heating rod, or a gas burner configured to generate a heated gas for cooking operations. Air handler(s) 46, 48 may be in fluid communication with convection heating element 50 to motivate heated gas from the convection heating element 50 and through a broil outlet 132 into the cooking chamber 14. Broil outlet 132 may be provided at or proximate to a top portion of the cooking chamber 14, e.g., at the top wall 30, such as at or proximate to an intersection of the top wall 30 with the rear wall 38. Moreover, during certain operations, broil outlet 132 may be downstream from air handler(s) 46, 48 and convection heating element 50 to receive a heated gas therefrom.

Advantageously, the heating elements 50 and 52 may employ different heat sources, e.g., the convection heating element 50 may be a gas burner and the radiant heating element 52 may be an electric heating element, such that the combined system, e.g., broiler assembly 44, provides advantages over broilers using a single energy source, such as only electric or only combustion. In such embodiments, the radiant heating element 52 may be a low-power heating element. Thus, the combined broiler assembly 44 may provide improved heat intensity as compared to a purely radiant or purely convective broil system. By bathing the electric element 52 in the hot air or exhaust from the convective heating element 50, the relatively low powered (e.g., about 1500 W) electric element 52 can achieve temperatures that will allow it to radiate substantial energy to food items in the cooking chamber, and together with the convective heat element 52 gives superior broil results.

Oven appliance 10 may further include a controller 40, e.g., configured to control one or more operations of the oven appliance 10. For example, controller 40 may control at least one operation of oven appliance 10 that includes broiler assembly 44. Controller 40 may be in communication (via for example a suitable wired or wireless connection) with the heating elements 50 and 52 as well as other suitable components of the oven appliance 10, as discussed herein. In general, controller 40 may be operable to configure the oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface panel 62 of oven appliance 10 as shown in FIGS. 1 and 2. In some such embodiments, input/output ("I/O") signals may be routed between controller 40 and various operational components of oven appliance 10, such as convection heating element 50, radiant heating element 52, air handler(s) 46, 48, controls 64, display component 66, sensors, alarms, and/or other components as may be provided. For instance, signals may be directed along one or more wiring harnesses that may be routed through cabinet 12.

In some embodiments, controller 40 is in communication with user interface panel 62 and controls 64 through which a user may select various operational features and modes and monitor progress of oven appliance 10. In one embodiment, user interface panel 62 may represent a general purpose I/O ("GPIO") device or functional block. In one embodiment, user interface panel 62 may include input components, such as one or more of a variety of electrical, mechanical or electro-mechanical input devices including rotary dials, push buttons, and touch pads. User interface panel 62 may include a display component 66, such as a digital or analog display configured to provide operational feedback to a user. User interface panel 62 may be situated above the door 16 and in front of the cooktop 140, wherein the front of oven appliance 10 includes door 16. User interface panel 62 may further be aligned with cooktop 140 in the vertical direction, such that an upper surface of user interface panel 62 is at substantially the same height as an upper surface of cooktop 140 (e.g., give or take half an inch).

Figure 3:
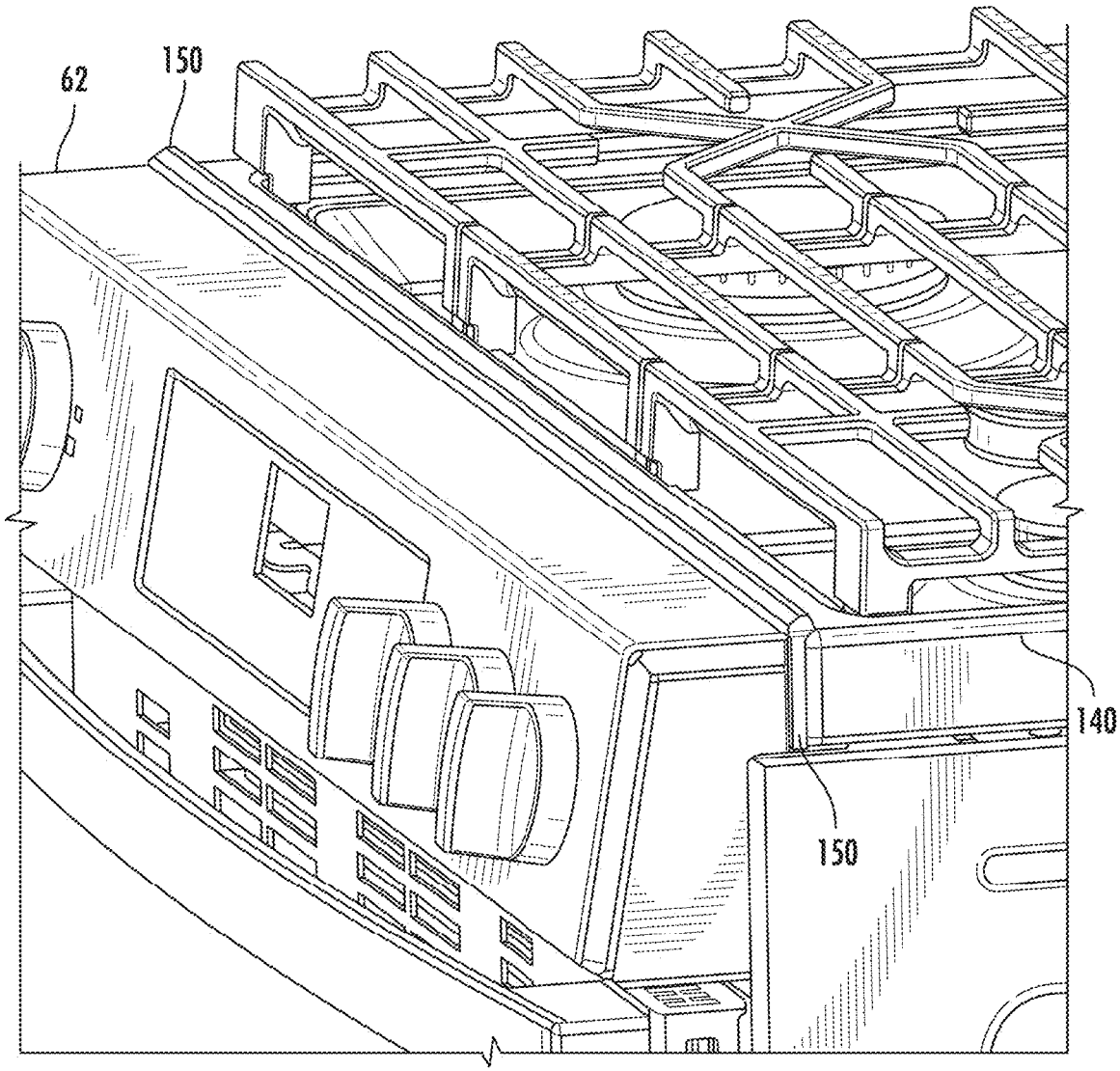
FIG. 3 provides a perspective view of the gasket interposed between the user interface panel and the cooktop in accordance with an exemplary embodiment of the present disclosure.
Figure 4:
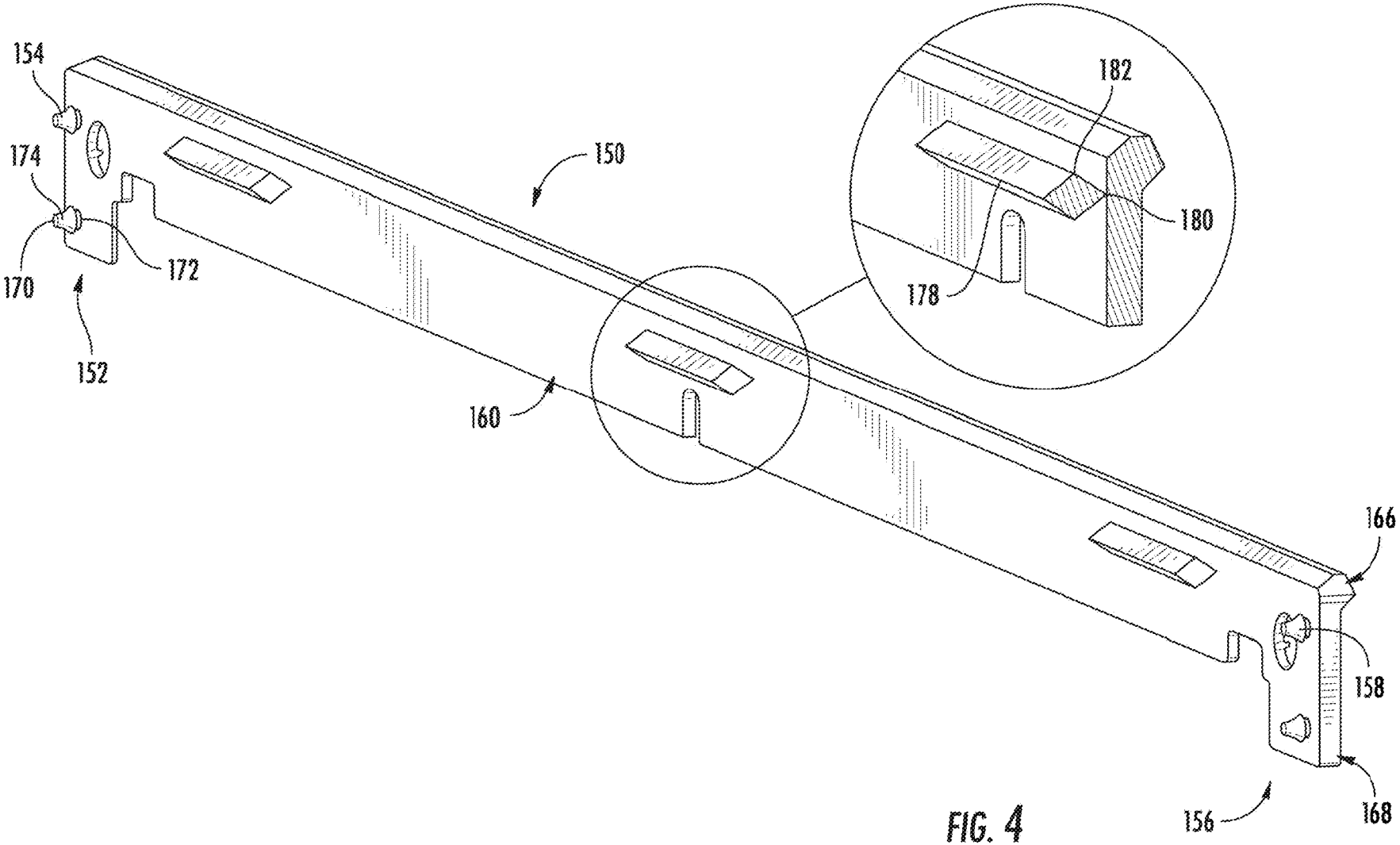
FIG. 4 provides a front perspective view of a gasket in accordance with an exemplary embodiment of the present disclosure.

The relative configuration of user panel 62 and cooktop 140 may leave a space between at least a portion of user panel 62 and cooktop 140. That space may be occupied by a gasket 150, as shown in FIG. 3. As further shown in FIG. 4, gasket 150 may include a first end 152 and a second end 156 space apart from each other in the lateral direction. Gasket 150 may further include a central body 160 connecting first end 152 and second end 156. Referring again to FIG. 3, in this embodiment, gasket 150 extends along the entire width of user interface panel 62 in the lateral direction. At least a portion of gasket 150 may also extend along the entire height of cooktop 140, thereby covering visible gaps between user interface panel 62 and cooktop 140. To accomplish this, gasket 150 may have a rectangular cross section, wherein first end 152, second end 156, and central body 160 have the same vertical height. In other embodiments, such as shown in FIG. 4, first end 152 and second end 156 may have a vertical height greater than central body 160. One of ordinary skill will recognize that other shapes consistent with the present disclosure may also be used, depending on the design and aesthetic requirements of the oven appliance 10.

Referring still to FIG. 4, in this embodiment, a first protrusion 154 may extend from first end 152 of gasket 150 in the transverse direction. Similarly, a second protrusion 158 may extend from second end 156 of gasket 150 in the transverse direction. In certain embodiments, first end 152 may include multiple protrusions, such as shown in the embodiment of FIG. 4. In this embodiment, first protrusion 154 may be spaced apart from the additional protrusion or protrusions in the vertical direction. In additional embodiments, first protrusion 154 may be spaced apart from the additional protrusion or protrusions in the lateral direction. In alternative embodiments, first protrusion 154 may be spaced apart from the additional protrusion or protrusions in both the vertical and lateral directions. In yet another embodiment, first protrusion 154 may be spaced apart from one or more additional protrusions in the vertical direction and from one or more additional protrusions in the lateral direction.

Likewise, in certain embodiments, second end 156 may include multiple protrusions, such as shown in the embodiment of FIG. 4. In this embodiment, second protrusion 158 may be spaced apart from the additional protrusion or protrusions in the vertical direction. In additional embodiments, second protrusion 158 may be spaced apart from the additional protrusion or protrusions in the lateral direction. In alternative embodiments, second protrusion 158 may be spaced apart from the additional protrusion or protrusions in both the vertical and lateral directions. In yet another embodiment, second protrusion 158 may be spaced apart from one or more additional protrusions in the vertical direction and from one or more additional protrusions in the lateral direction. One of ordinary skill will recognize that other orientations of protrusions on the first end 152 and the second end 156 of gasket 150 that dictate the lateral position of gasket 150 with respect to its point of attachment, as further described herein, are intended to fall within the scope of the present disclosure.

Figure 7:
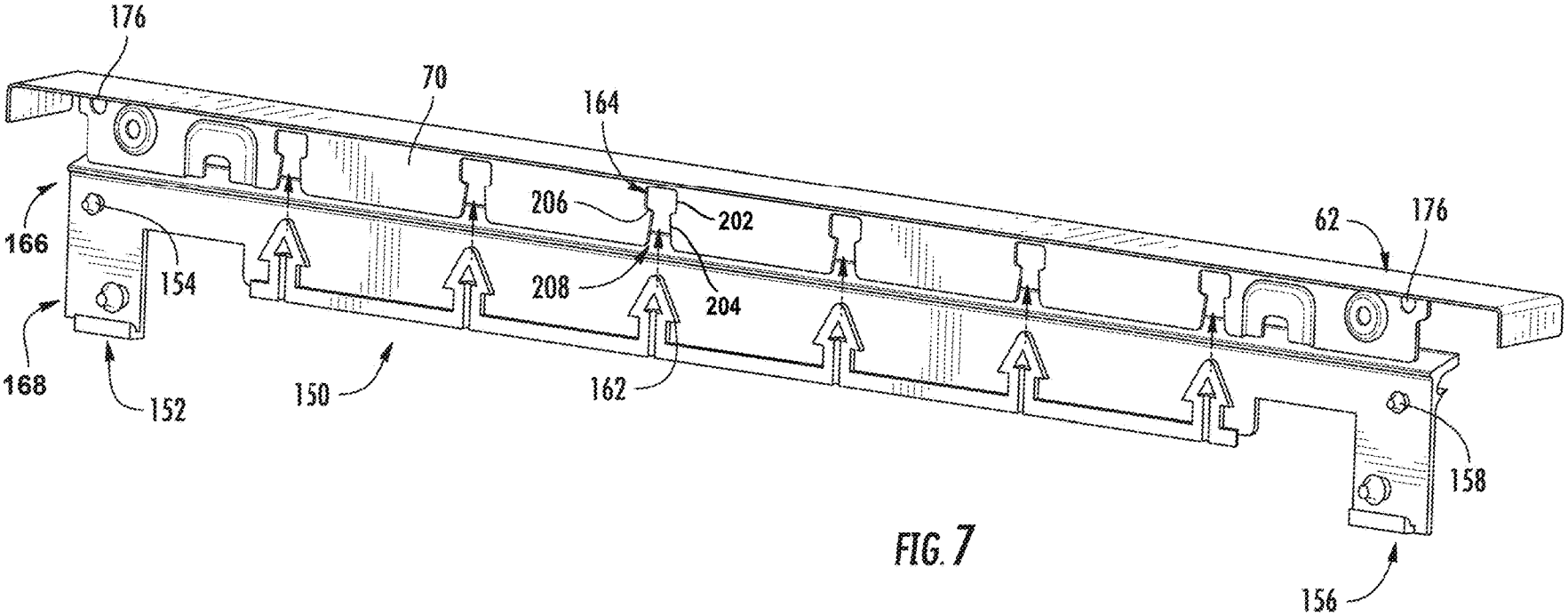
FIG. 7 provides a perspective view of a user interface panel and gasket configured for attaching the gasket to the user interface panel in accordance with an exemplary embodiment of the present disclosure.
Figure 8:
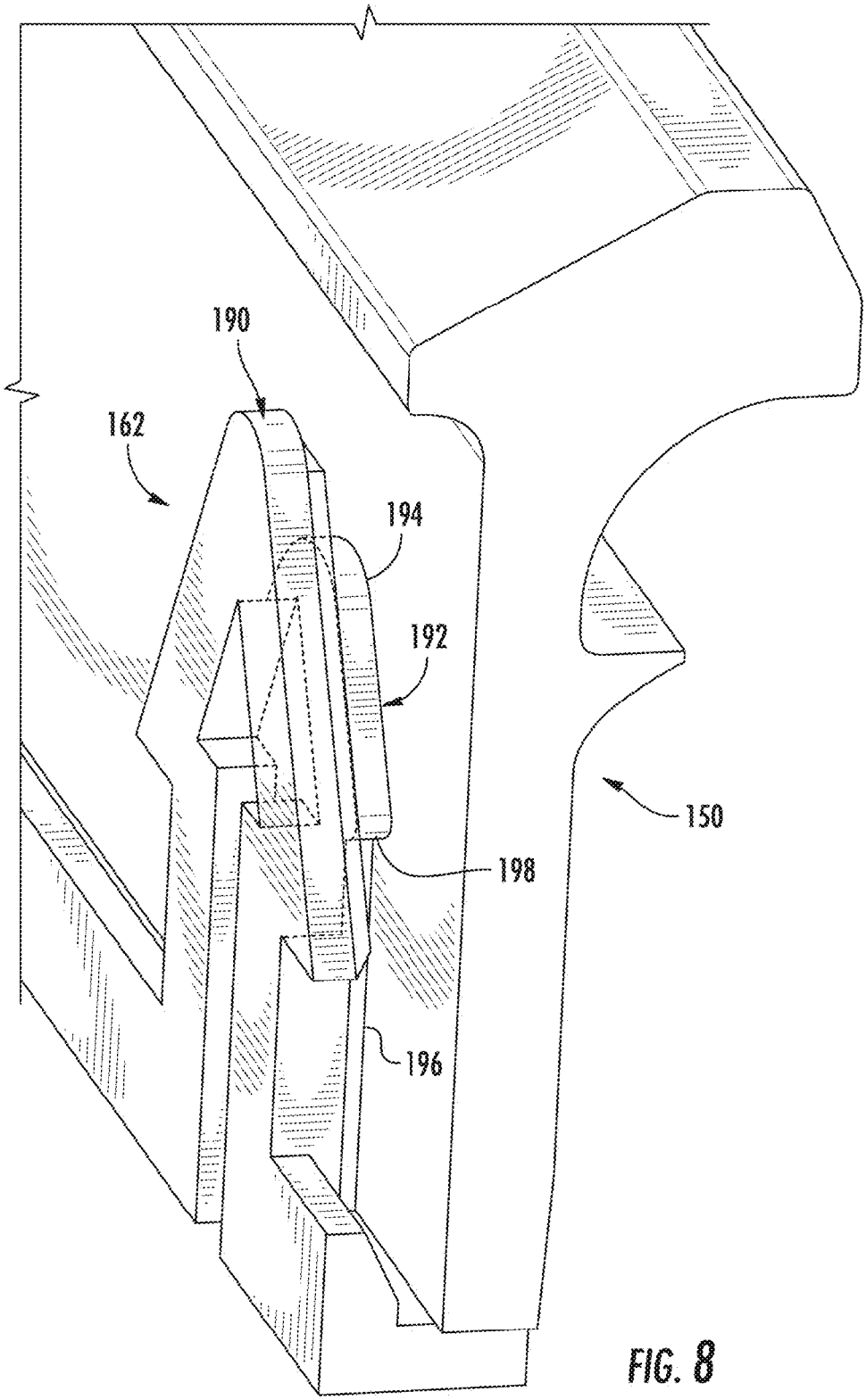
FIG. 8 provides a perspective view of a protrusion extending from a gasket body in accordance with an exemplary embodiment of the present disclosure.

Gasket 150 may further include a third protrusion 162 extending from central body 160 of gasket 150, as shown in the embodiments of FIGS. 4 and 8. In these embodiments, in addition to third protrusion 162, gasket 150 includes multiple protrusions spaced in the lateral direction along central body 160. In alternative embodiments, third protrusion 162 may be the only protrusion extending of central body 160. In the embodiment of FIG. 4, third protrusion 162 is centered on gasket 150. Alternatively, or additionally, third protrusion 162 may extend laterally along a portion of, or along the entire width of, central body 160. In embodiments including multiple protrusions extending from central body 160, the protrusions may be evenly spaced apart from one another, but need not be, Gasket 150 may further be conceptually divided into an upper portion 166 and a lower portion 168, wherein upper portion 166 and lower portion 168 are defined along the lateral centerline of central body 160. In some embodiments, such as the one shown in FIG. 4, third protrusion 162 extends from upper portion 166 of gasket 150. In some embodiments, third protrusion 162, as well as any additional protrusions extending from central body 160, may be situated at the upper-most position of upper portion 166 of central body 160 that is permitted by the design of oven appliance 10, and that does not diminish the aesthetic of the gasket when assembled, to minimize lifting of gasket 150. However, it will be recognized that such placement is not necessary to fall within the scope of the present disclosure. For example, as shown in FIGS. 7 and 8, third protrusion 162, along with any additional protrusions from central body 160 of gasket 150, may extend from the lower portion 168 to upper portion 166. In this embodiment, third protrusion 162 limits lifting of gasket 150 as a result of the increased surface area of gasket 150 in contact with user interface panel 62 or cooktop 140, as further described herein.

Third protrusion 162 may be a locator for fixing the vertical position of gasket 150 with respect to user interface panel 62 or cooktop 140, as further described herein. The locators may be made from an elastic material, such as rubber, that may be deformed and return to its original shape. In certain embodiments, the locators may include a first end 178 and a second end 180 spaced apart from each other in the transverse direction (FIG. 4). The locators may further include a central portion 182 connecting first end 178 and second end 180, wherein at least a portion of central portion 182 is wider in the vertical direction that the width of first end 179 and second end 180 in the vertical direction, as shown in FIG. 4. In alternative embodiments, such as shown in FIG. 8, third protrusion 162 may also be a locator having an outer portion 190 and an inner portion 192. Inner portion 192 may include a head 194 connected to a body 196, wherein the lateral width of head 194 is greater than the lateral width of body 196 at the point of connection such that head 194 and body 196 together define a lip 198. Additionally, in some embodiments, such as shown in FIGS. 7 and 8, outer portion 190 may be shaped to serve as an indicator, for example, in the shape of an arrow, although other shapes are possible. This indicator enables installers to more easily align the locators in the correct position with respect to connection points on user interface 62 or cooktop 140.

In the embodiments of FIGS. 4 and 7, first protrusion 154 and second protrusion 158 are connectors for securing gasket 150 to user interface panel 62 or cooktop 140, as further described herein. Each connector may include a first end 170 and a second end 172 spaced apart from one another in the transverse direction. Each connector may further include a central portion 174 between the first end 170 and the second end 172. The width (i.e., lateral dimension) of first end 170 and second end 172 of each connector is less than the width (i.e., lateral dimension) of at least a portion of the central portion 174 of the connector. In certain embodiments, first end 152 of gasket 150 may include multiple connectors spaced apart from each other, for example, in the vertical direction (FIG. 4), the lateral direction, the vertical and lateral directions (FIG. 7), or combinations thereof, as previously explained. Similarly, second end 156 of gasket 150 may include multiple connectors spaced apart from each other, for example, in the vertical direction, the lateral direction, the vertical and lateral directions, or combinations thereof, as previously explained.

In alternative embodiments, first protrusion 154 and second protrusion 158 may be locators for fixing the horizontal position of gasket 150 with respect to user interface panel 62 or cooktop 140, as further described herein. In such embodiments, the locators will have the same characteristics previously described with respect the third protrusion 162 when constituting a locator.

Figure 5:
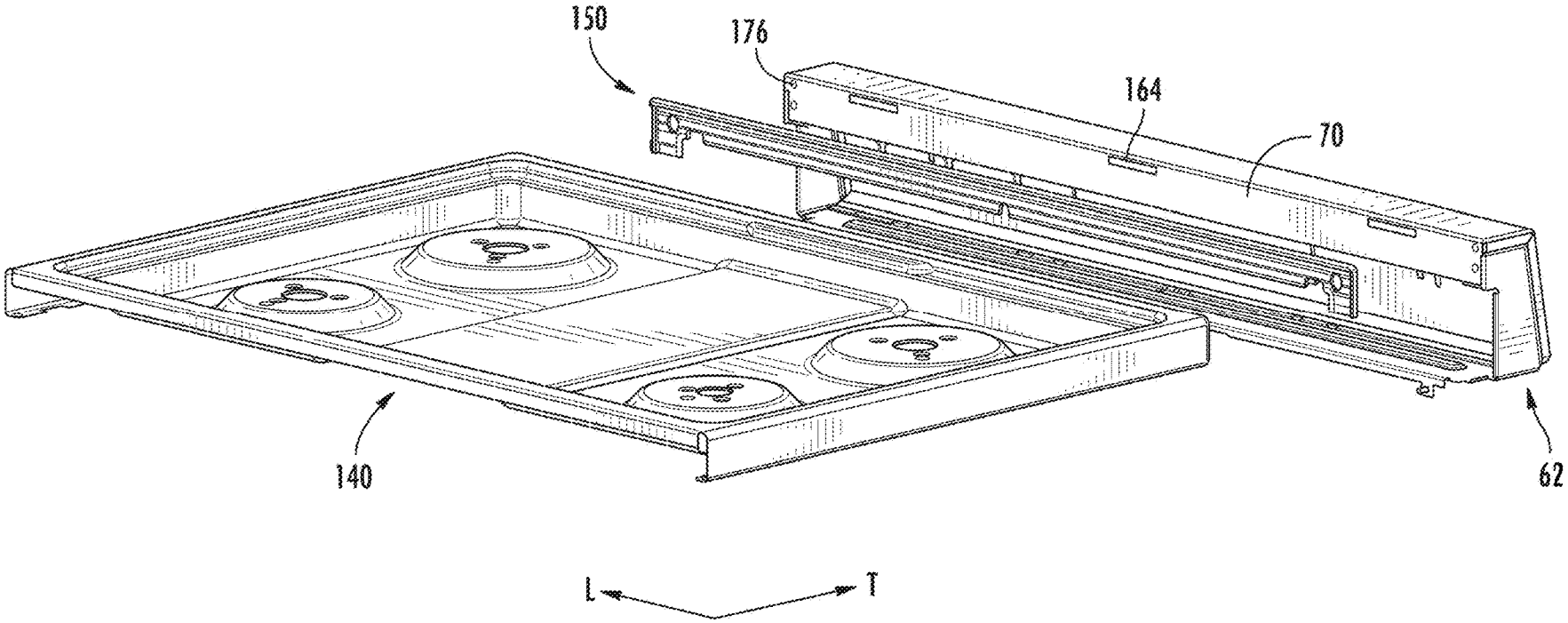
FIG. 5 provides an exploded rear perspective view of a user interface panel, gasket, and cooktop configured for attaching the gasket to the user interface panel in accordance with an exemplary embodiment of the present disclosure.

In one embodiment, gasket 150 may be attached to user interface panel 62, as shown in the exploded view of FIG. 5. In this embodiment, user interface panel 62 may include a rear surface 70 (i.e., the vertical surface closest to cabinet 12) and gasket 150 may be attached to rear surface 70. Rear surface 70 of user interface panel 62 may include a slot 164 aligned with third protrusion 162 on central body 160 of gasket 150 for receiving third protrusion 162, wherein the width of slot 164 in the vertical direction is less than the width of central portion 182 of third protrusion 162. Third protrusion 162 may be inserted into slot 164 by the application of a force to gasket 150 in the direction of user interface panel 62. The design of third protrusion 162 is such that the applied force collapses central portion 182 to vertical width less than the vertical width of slot 164, thereby allowing third protrusion 162 to pass through slot 164. After passing through slot 164, the elasticity of third protrusion 162 causes central portion 182 to expand to its original width, thereby resisting third protrusion's exit from slot 164. While this design is not intended to permanently secure gasket 150 to user interface panel 62, it does provide a sufficient level of attachment to hold gasket 150 in place during the assembly process.

Slot 164 may also be wider in the lateral direction than the width of third protrusion 162 in the lateral direction. Thus, following insertion of third protrusion 162 into slot 164, gasket 150 may be moved laterally to align first protrusion 154 and second protrusion 158 with their points of attachment, as further described herein. For embodiments involving multiple protrusions extending from central body 160, rear surface 70 of user interface panel 62 will include multiple slots 164, each slot 164 aligned with a protrusion. Further, the number of slots 164 will be equal to the number of protrusions extending from central body 160 of gasket 150.

In the alternative embodiment shown in FIG. 7, gasket 150 is also attached to rear surface 70 of user interface panel 62. As before, rear surface 70 of user interface panel 62 may include slot 164 aligned with third protrusion 162 on central body 160 of gasket 150 for receiving third protrusion 162. However, in this embodiment, slot 164 includes a slot head 202 intersecting with a slot body 204, where the lateral width of slot head 202 is greater than the lateral width of slot body 204 at the point of intersection, defining a shelf 206. Further, slot body 204 extends vertically from slot body 202 to the bottom of central body 160 of gasket 150 such that slot 164 is open at its bottom 208. Slot body 204 also has a lateral width greater than the lateral width of body 196 of inner portion 192 of third protrusion 162 and less than the lateral width of at least a portion of outer portion 190 of third protrusion 162. Likewise, slot head 202 has a lateral width greater than the lateral width of head 194 of inner portion 192 of third protrusion and less than the lateral width of at least a portion of outer portion 190.

As a result of these relationships and the elasticity of third protrusion 162, inner portion 192 of third protrusion 162 may be slid upward into slot 164 by the application of a force to gasket 150 in the vertical direction. Once third protrusion 162 is inserted into slot 164, in this embodiment, outer portion 190 and central body 160 limit transverse movement of gasket 150. Further, lip 198 of inner portion 192 of third protrusion 162 abuts shelf 206 following insertion, thereby limiting movement of gasket 150 in the vertical direction. While this design is not intended to permanently secure gasket 150 to user interface panel 62, it does provide a sufficient level of attachment to hold gasket 150 in place during the assembly process. Although the description herein is provided specifically with respect to third protrusion 162 and slot 164, the same disclosure would apply to any combination of aligned protrusions extending from central body 160 of gasket 150 and slots on either user interface panel 62 or cooktop 140.

Rear surface 70 of user interface panel 62 may further include two or more attachment holes 176 that align with first protrusion 154 and second protrusion 158. Attachment holes 176 may have a width greater than first end 170 and second end 172 of first protrusion 154 and second protrusion 158. Attachment holes 176 may further have a width less than at a least a portion of central portion 174 of first protrusion 154 and second protrusion 158. In embodiments which include multiple protrusions on each of first end 152 and second end 156 of gasket 150, rear surface 70 of user interface panel 62 will include multiple attachment holes 176, each attachment hole 176 aligned with a protrusion. Further, the number of attachment holes 176 will be equal to the number protrusions extending from first end 152 and second end 156 of gasket 150.

Since first protrusion 154 and second protrusion 158, along with any additional protrusions on first end 152 and second end 156, may be connectors or locators in alternative embodiments, it will be understood that attachment holes 176 may take on various shapes and sizes in accordance with this disclosure to accommodate the type of first protrusion 154 and second protrusion 158. In embodiments where first protrusion 154, second protrusion 158, or any other protrusions on first end 152 or second end 156 are locators, attachment holes 176 may comprise the same characteristics as slot 164 with the exception that attachment holes 176 may be wider in the vertical direction that the width of the corresponding first protrusion 154, second protrusion 158, or the additional protrusions in the vertical direction.

First protrusion 154 and second protrusion 158, along with any additional protrusions extending from first end 152 and second end 156 of gasket 150, may be inserted in their corresponding attachment holes 176 to secure gasket 150 to user interface panel 62. The design permits compression of each protrusion upon insertion to allow passage of the protrusion through the corresponding attachment hole, but does not permit such compression on extraction, thus preventing removal of the protrusion. In particular, each of first protrusion 154 and second protrusion 158, along with any additional protrusions extending from first end 152 and second end 156 of gasket 150, is configured to compress central portion 174 of the first protrusion 154, second protrusion 158, or any additional protrusion in the lateral direction upon application of a force in the direction of the corresponding attachment hole 176 when inserting first protrusion 154, second protrusion 158, or any additional protrusion on first end 152 and second end 156 of gasket 150. Conversely, each of first protrusion 154 and second protrusion 158, along with any additional protrusions extending from first end 152 and second end 156 of gasket 150, is configured not to compress central portion 174 of first protrusion 154, second protrusion 158, or any additional protrusion in the lateral direction upon the application of a force in the direction of the corresponding attachment hole 176 when extracting first protrusion 154, second protrusion 158, or any additional protrusion on first end 152 and second end 156 of gasket 150.

Figure 6:
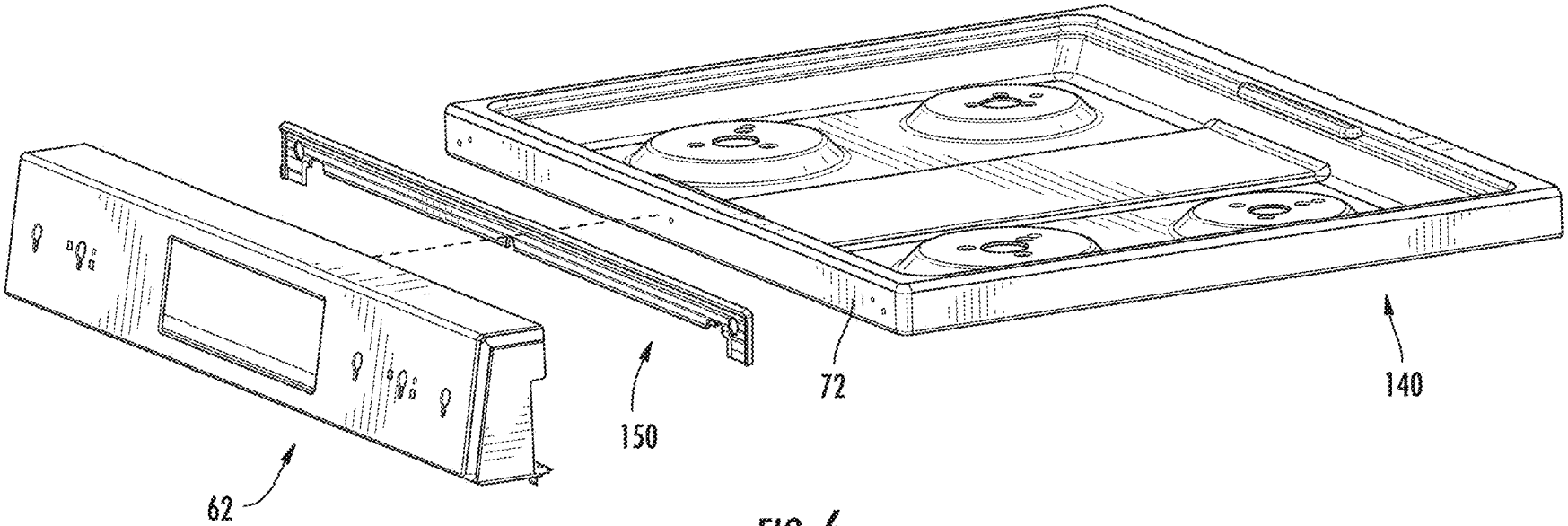
FIG. 6 provides an exploded front perspective view of a user interface panel, gasket, and cooktop configured for attaching the gasket to the cooktop in accordance with an exemplary embodiment of the present disclosure.

In alternative embodiments, gasket 150 may be attached to cooktop 140, rather than user interface panel, as illustrated in FIG. 6. In such embodiments, the protrusions of gasket 150 extend in the transverse direction toward cooktop 140. Cooktop 140, in this embodiment, includes a front surface 72 and gasket 150 is attached to front surface 72 of cooktop 140 in same manner as the previously described attachment of gasket 150 to user interface panel 62, but with front surface 72 of cooktop 140 serving as the connecting surface, rather than rear surface 70 of user interface panel 62. That is, the one or more slots 164 for accommodating the protrusions extending from central body 160 of gasket 150 are located on front surface 72 of cooktop 140 in this embodiment, sharing the same characteristics and interfacing with the protrusions from gasket 150 as previously described. Further, the one or more attachment holes 176 for accommodating the protrusions extending from first end 152 and second end 156 of gasket 150 are located on front surface 72 of cooktop 140 in this embodiment, sharing the same characteristics and interfacing with the protrusions from gasket 150 as previously described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a cooking chamber to receive items to be cooked and further including comprising a cooktop situated above the cooking chamber;

a door pivotably attached to the cabinet, wherein the door pivots between an open position and a closed position and the door covers a front opening of the cooking chamber when the door is in the closed position;

a user interface panel situated above the door and vertically aligned with and in front of the cooktop, the user interface panel comprising a slot, the slot comprising a slot head that intersects with a slot body, a lateral width of the slot head is greater than a lateral width of the slot body at the point of intersection, the slot defining a shelf;

a gasket occupying the space between the user interface panel and the cooktop, the gasket further comprising a first end;

a first protrusion extending from the first end, the first protrusion engaged with the user interface panel to fix a horizontal position of the gasket with respect to the user interface panel;

a second end spaced apart from the first end in the lateral direction;

a second protrusion extending from the second end, the second protrusion engaged with the user interface panel to fix the horizontal position of the gasket with respect to the user interface panel;

a central body connecting the first end to the second end; and a third protrusion extending from the central body, the third protrusion engaged with the user interface panel to fix a vertical position of the gasket with respect to the user interface panel, wherein the third protrusion is received within the slot.

2. The oven appliance of claim 1, wherein the user interface panel includes a rear surface and the gasket is attached to the rear surface of the user interface panel.

3. The oven appliance of claim 1, wherein the cooktop includes a front surface and the gasket is attached to the front surface of the cooktop.

4. The oven appliance of claim 2, wherein the rear surface of the user interface panel includes the slot for receiving the third protrusion of the gasket.

5. The oven appliance of claim 2, wherein the gasket includes multiple protrusions distributed laterally along the central body of the gasket and the rear surface of the user interface panel includes multiple slots, the number of slots being equal to the number of protrusions from the central body of the gasket.

6. The oven appliance of claim 1, wherein the slot is open at a bottom of the slot.

7. The oven appliance of claim 6, wherein the third protrusion further includes an inner portion and an outer portion, the inner portion of the third protrusion comprising a head connected to a body, wherein the lateral width of the head is greater than the lateral width of the body at the point of connection such that the head and the body together define a lip.

8. The oven appliance of claim 7, wherein the inner portion of the third protrusion slides vertically into the slot and, after insertion, the lip of the inner portion abuts the shelf of the slot limiting vertical movement of the gasket and the outer portion of the third protrusion limits transverse movement of the gasket.

9. An oven appliance comprising:

a cabinet defining a cooking chamber to receive items to be cooked and further comprising a cooktop situated above the cooking chamber;

a door pivotably attached to the cabinet, wherein the door pivots between an open position and a closed position and the door covers a front opening of the cooking chamber when the door is in the closed position;

a user interface panel situated above the door and is vertically aligned with and in front of the cooktop, user interface panel comprising a rear surface, the rear surface comprising a slot, the slot comprising a slot head that intersects with a slot body, a lateral width of the slot head being greater than a lateral width of the slot body at the point of intersection, the slot defining a shelf;

a gasket occupying the space between the user interface panel and the cooktop and attached to the rear surface of user interface panel, the gasket further comprising a first end;

a first protrusion extending transversely from the first end, the first protrusion engaged with the rear surface of the user interface panel to fix a horizontal position of the gasket with respect to the user interface panel;

a second end spaced apart from the first end in the lateral direction;

a second protrusion extending from the second end, the second protrusion engaged with the rear surface of the user interface panel to fix a horizontal position of the gasket with respect to the user interface panel;

a central body connecting the first end to the second end, the gasket divided into an upper portion and a lower portion along a lateral centerline of the central body; and a third protrusion extending transversely from the central body toward the user interface panel, the third protrusion further extending vertically from the lower portion to the upper portion, the third protrusion engaged with the user interface panel to fix a vertical position of the gasket with respect to the user interface panel, wherein the third protrusion is received within the slot.

10. The oven appliance of claim 9, wherein the gasket includes multiple protrusions distributed laterally along the central body of the gasket and the rear surface of the user interface panel includes multiple slots, the number of slots being equal to the number of protrusions from the central body of the gasket.

11. The oven appliance of claim 9, wherein the slot is open at a bottom of the slot.

12. The oven appliance of claim 11, wherein the third protrusion further includes an inner portion and an outer portion, the inner portion of the third protrusion comprising a head connected to a body, wherein the lateral width of the head is greater than the lateral width of the body at the point of connection such that the head and the body together define a lip.

13. The oven appliance of claim 12, wherein the inner portion of the third protrusion slides vertically into the slot and, after insertion, the lip of the inner portion abuts the shelf of the slot limiting vertical movement of the gasket and the outer portion of the third protrusion limits transverse movement of the gasket.

14. The oven appliance of claim 12, wherein the outer portion of the third protrusion is shaped to provide an indication of the location of the third protrusion to aid in alignment with the slot.

* * * * *